US006759369B2

(12) United States Patent
Simpson et al.

(10) Patent No.: US 6,759,369 B2
(45) Date of Patent: Jul. 6, 2004

(54) THERMAL DYE TRANSFER PRINT BEARING PATTERNED OVERLAYER AND PROCESS FOR MAKING SAME

(75) Inventors: William H. Simpson, Pittsford, NY (US); David A. Johnson, Rochester, NY (US); Cobb S. Goff, Webster, NY (US); David E. Coons, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 149 days.

(21) Appl. No.: 10/213,991

(22) Filed: Aug. 7, 2002

(65) Prior Publication Data

US 2004/0029732 A1 Feb. 12, 2004

(51) Int. Cl.[7] ..... B41M 5/035; B41M 5/38

(52) U.S. Cl. ..... 503/227; 156/235

(58) Field of Search ..... 8/471; 156/235; 503/227; 428/327, 402.2, 402.21, 402.22

(56) References Cited

U.S. PATENT DOCUMENTS 6,092,942 A 7/2000 Koichi et al.
6,346,502 B1 2/2002 Simpson et al.

FOREIGN PATENT DOCUMENTS

GB 2 348 509 10/2000

*Primary Examiner*—Bruce H. Hess
(74) *Attorney, Agent, or Firm*—Kathleen Neuner Manne

(57) ABSTRACT

Disclosed is a thermal dye transfer print bearing a protective overlayer comprising a polymeric binder containing dispersed heat expandable microspheres wherein the expandable microspheres have been selectively expanded in a predetermined pattern and a process for making same. The resulting prints bear a predetermined texture pattern in the protective overlayer.

19 Claims, No Drawings

THERMAL DYE TRANSFER PRINT BEARING PATTERNED OVERLAYER AND PROCESS FOR MAKING SAME

FIELD OF THE INVENTION

The invention relates to a thermal dye transfer print comprising a protective overlayer including a polymeric binder containing dispersed heat expandable microspheres wherein the expandable microspheres have been selectively expanded in a predetermined pattern.

BACKGROUND OF THE INVENTION

U.S. Pat. No. 6,092,942 (Koichi et al.) includes a thermal dye donor element composed of a yellow, magenta and cyan dye patch plus a protective overlayer which is applied to the receiver layer containing the printed image by means of a thermal print head. The protective layer is applied by using an image plane as a mask as opposed to a uniform application of energy down the page. The protective layer image is designed to have low and high energy arranged in a pattern to produce corresponding regions of density in the transferred protective layer. The final pattern in the transferred protective layer imparts a satin or matte like appearance to the surface of the dye receiver by changing the thickness of the protective layer. The use of a protective layer made in this manner limits the coarseness of the texture that can be applied.

U.S. Pat. No. 6,346,502 (Simpson et al.) and UK Patent Specification 2,348,509 (Lum et al.) teach the use of expandable microspheres in a protective layer to impart a satin or matte finish to dye-diffusion thermal transfer prints. The application of heat during transfer of the protective layer from the donor element to the receiver layer causes the microspheres, which are filled with an easily vaporized fluid, to expand in size. The larger size microspheres scatter light more efficiently giving the appearance of a satin or matte finish to the print. The level of gloss may be controlled by the amount of heat applied to the layer. Application of the protective layer can be done with a thermal print head or other devices, such as a heated roller.

It is a problem to be solved to provide a protective overlayer for a dye transfer print that enables a broader range of patterned textures to be applied to the overlayer.

SUMMARY OF THE INVENTION

The invention provides a thermal dye transfer print bearing a protective overlayer comprising a polymeric binder containing dispersed heat expandable microspheres wherein the expandable microspheres have been selectively expanded in a predetermined pattern. The invention also provides a process for making such prints.

The invention enables a broad range of patterned textures to be applied to the overlayer.

DETAILED DESCRIPTION OF THE INVENTION

As used herein the term "patterned" means a macroscopic pattern in which the pattern present in one square centimeter is not the same as in every other square centimeter of the overlayer. "Microspheres" means generally spheroidal or ellipsoidal shaped beads of expandable material.

The invention is summarized above. It encompasses a thermal dye transfer print bearing a protective overlayer comprising a polymeric binder containing dispersed heat expandable microspheres wherein the expandable microspheres have been selectively expanded in a predetermined pattern and a process for making the same. Suitably, the print of the invention is one wherein the pattern is a macroscopic textile-like repeating pattern. Alternatively, the pattern is an information-bearing pattern especially one that is machine readable or is humanly readable visually or by touch. The protective overlayer may further suitably comprise inorganic particles such as silica particles.

The print of the invention encompasses overlayer arrangements wherein the microspheres are selectively expanded or not depending on a macroscopic location and wherein the microspheres are selectively expanded by various degrees of expansion depending on location.

The print of the invention includes overlayer arrangements wherein the protective overlayer additionally comprises an IR absorbing dye or where the thickness of the protective overlayer varies.

The process for forming the overlayer on a thermal dye transfer print comprises:

1) applying to the print a solid sheet comprising a polymeric binder containing dispersed heat expandable microspheres; and
2) applying heat selectively to the surface of the overlayer sheet so that the expandable microspheres are selectively expanded in a predetermined pattern.

Suitably, in the process of the invention the heat is applied via a thermal print head, especially one where the thermal print head is variable as to which pixels are energized and/or the extent to which pixels are energized. The thermal print head used to heat the protective overlayer is desirably a separate print head from that used to transfer the imaging dye. Alternatively, the overlayer contains an IR dye and the heat is applied via selective application of a laser beam.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

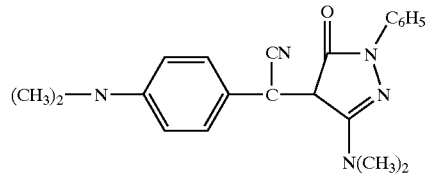

(magenta)

-continued

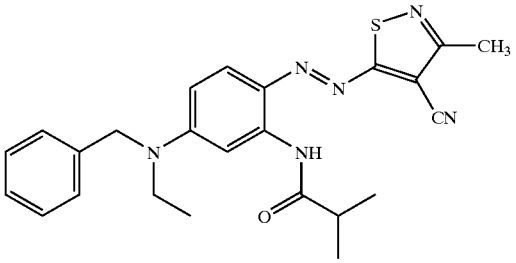

(magenta)

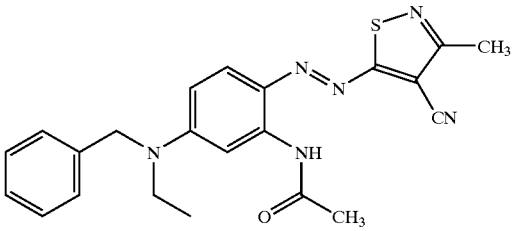

(magenta)

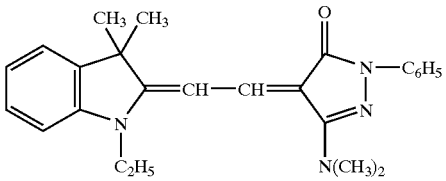

(yellow)

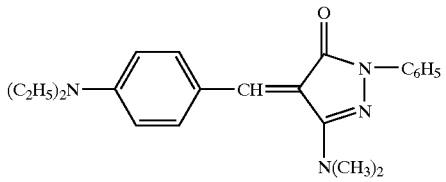

(yellow)

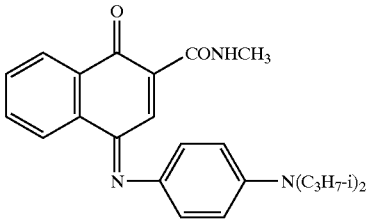

(cyan)

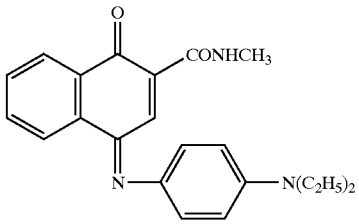

(cyan)

-continued

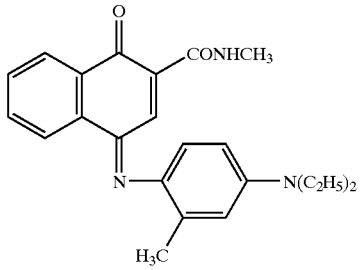

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the back side of the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly (vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermally expandable microspheres or beads, such as those manufactured as Expancel® by Expancel, Inc., having an average diameter of from six to seventeen microns can be used to impart a matte or textured finish within the scope of this invention. An average diameter of from six to nine microns in the unexpanded state is preferable. Also, it is preferable that the polymeric wall of the microsphere have a softening temperature between 95 and 130° C. and be resistant to attack by solvents commonly used in the preparation of solutions for gravure coating.

Thermal printing heads, which can be used to transfer dye from the dye-donor elements of the invention, are available commercially. There can be employed, for example, a Fujitsu Thermal Head FTP-040 MCSOO1, a TDK Thermal Head LV5416 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be pre-assembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

EXAMPLES

A. Receiver Element

In the following examples, the receiver element consisted of three layers coated on Eastman Kodak Electronic print paper support as described in U.S. Pat. Nos. 5,858,916 and 5,858,919. Since the important interaction for successful transfer of a protective layer takes place between the protective layer and the topmost layer of the receiver element, the support of the latter acts only as a carrier of the receiver layers and may consist of any material compatible with the bottom-most receiver layer.

The first layer, which was coated directly on the support consisted of 0.1076 g/m$^2$ Prosil 221, an aminopropyltriethoxysilane, (PCR, Inc.), 0.1076 g/m$^2$ Prosil 2210, a proprietary epoxy trialkoxy silane, (PCR, Inc.) and LiCl (0.0022 g/m$^2$) in an ethanol-methanol-water solvent mixture.

The second layer consisted of Makrolon KL3-1013 (Bayer AG) at 1.52 g/m$^2$, Lexan 141-112 polycarbonate (General Electric Co.) at 1.24 g/m$^2$, FC431 (3M Corp.) at 0.011 g/m$^2$, Drapex® 429 polyester plasticizer (Witco Corp) (0.23 g/m$^2$), 8 $\mu$m crosslinked poly(styrene-co-butyl acrylate-co-divinylbenzene) elastomeric beads (Eastman Kodak Co.) (0.006 g/m$^2$) and diphenylphthalate at 0.46 g/m from dichloromethane.

The third, and topmost layer of the receiver element consisted of a copolymer of 50 mole-% bisphenol A, 49 mole-% diethylene glycol and 1 mole-% of a poly (dimethylsiloxane) block at a laydown of 0.55 g/m$^2$, FC431 at 0.022 g/m$^2$, and DC510 silicone fluid surfactant (Dow Corning) at 0.003 g/m$^2$.

B. Donor Element

Protective layer donor elements were prepared by coating on 6 $\mu$m PET (poly(ethylene terephthalate)) support:

On the back side of the element were coated the following layers in sequence:

1) a subbing layer of 0.13 g/m$^2$ titanium butoxide (Dupont Tyzor TBT®) from an 85% n-propyl acetate and 15% n-butyl alcohol solvent mixture.

2) a slipping layer containing an aminopropyl-dimethyl-terminated polydimethylsiloxane, PS513 (United Chemical Technologies, Bristol, Pa.) (0.011 g/m$^2$), a poly(vinylacetal)( Sekisui KS-1) binder (0.38 g/m$^2$), p-toluenesulfonic acid (0.0003 g/m$^2$), candellila wax (0.022 g/m$^2$) coated from a solvent mixture of diethylketone, methanol and distilled water (88.7/9.0/2.3)

Control Element C-1

On the front side of the element was coated a transferable overcoat layer of poly(vinyl acetal), KS-1, (Sekisui Co.), at a laydown of 0.63 g/m$^2$, colloidal silica, IPA-ST (Nissan Chemical Co.), at a laydown of 0.462 g/m$^2$, and divinylbenzene beads, 4 micron average diameter, (Eastman Kodak Company), at a laydown of 0.011 g/m$^2$, coated from a 79% 3-pentanone and 21% methanol mixture.

Element 1 of the Invention

On the front side of the element was coated a transferable overcoat layer of poly(vinyl acetal), KS-1, (Sekisui Co.), at a laydown of 0.432 g/m$^2$, colloidal silica, MA-ST-M (Nissan Chemical Co.), at a laydown of 0.335 g/m$^2$, poly(vinyl butyral), Butvar B-76®, (Solutia Inc.) at a laydown of 0.043 g/m$^2$, Expancel microspheres 461-20-DU (Expancel Inc.), at a laydown of 0.38 g/m$^2$, coated from a 75% 3-pentanone and 25% methanol solvent mixture.

C. Image Plane Giving Coarse Texture

In the example generated below an image plane in the form of a checkerboard pattern was created from individual pixels by selecting the size of the individual squares in the checkerboard to be one or more pixels (eg.—nine pixels/square). The applied energy was adjusted through the digital value assigned to the number of pulses.

D. Test Conditions

Using Kodak Professional EKTATHERM XLS XTRALIFE Color Ribbon (Eastman Kodak Co. Catalog No. 807-6135) and a sensitometer based on the mechanical mechanism from a Kodak Model 8300 Thermal Printer a Status A neutral density image with a maximum density of at least 2.3 was printed on the receiver described above. The color ribbon-receiver assemblage was positioned on an 18 mm platen roller and a TDK LV5406A (Kodak P/N 989014) thermal head (Serial No. 3K0345) with a head load of 6.35 Kg was pressed against the platen roller. The TDK 3K0345 thermal print head has 2560 independently addressable heaters with a resolution of 300 dots/inch and an average resistance of 3314Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 58 μsec every 76 μsec. Printing maximum density required 64 pulses "on" time per printed line of 5.0 msec. The voltage supplied was 13.6 volts resulting in an instantaneous peak power of approximately 58.18×10−3 Watt/dot and the maximum total energy required to print Dmax was 0.216 mJoules/dot. The process is repeated sequentially, yellow, magenta, cyan to obtain the desired neutral image.

An unprinted receiver sheet described above was used as the Status A minimum density sample.

Application of the transferable overcoat layer to the receiver layer was done using a head voltage of 13.6 volts with an enable width of 72 microseconds. The size of the print is 2400×2680 pixels. Digital print values of 0,100,255 were used to produce the contrast in the transferable overcoat image file, where a zero produces the maximum energy at the pixel. The size of high and low-density pixel blocks was varied from 3×6 to 9×9.

TABLE 1

Texture Applied to Status A Maximum and Minimum Density

| Transferable Overcoat | Image Density | Digital Print Values | Size Pixel Area | Texture Rating |
|---|---|---|---|---|
| C-1 | Dmax | 0, 100 | 3 × 6 | 0 |
| Invention 1 | Dmax | 0, 100 | 3 × 6 | + |
| C-1 | Dmin | 0, 100 | 3 × 6 | 0 |
| Invention 1 | Dmin | 0, 100 | 3 × 6 | + |

0 = no texture
+ = obvious texture

TABLE 2

Improvement of Metallic Appearance

| Transferable Overcoat | Image Density | Digital Print Values | Size Pixel Area | Metallic Appearance |
|---|---|---|---|---|
| C-1 | Dmax | 0, 255 | 9 × 9 | − |
| Invention 1 | Dmax | 0, 255 | 9 × 9 | + |
| C-1 | Dmin | 0, 255 | 9 × 9 | − |
| Invention 1 | Dmin | 0, 255 | 9 × 9 | + |

+ = No metallic appearance
− = A metallic appearance

The results in Table 1 show that, when a texture pattern is printed onto an overprotective layer containing thermally expandable microspheres, an improvement in the level of texture is observed when compared to an over-protective layer with no expandable beads. The results in Table 2 show that less metallic appearance is observed when thermally expandable microspheres are included in the over-protective laminate.

The entire contents of the patents and other publications referred to in this specification are incorporated herein by reference.

What is claimed is:

1. A thermal dye transfer print bearing a protective overlayer comprising a polymeric binder containing dispersed heat expandable microspheres wherein the expandable microspheres have been selectively expanded in a predetermined pattern.

2. The print of claim 1 wherein the pattern is a textile-like repeating pattern.

3. The print of claim 1 wherein the pattern is an information-bearing pattern.

4. The print of claim 3 wherein the information-bearing pattern is machine readable.

5. The print of claim 3 wherein the information-bearing pattern is humanly readable.

6. The print of claim 5 wherein the information-bearing pattern is humanly readable by touch.

7. The print of claim 5 wherein the information-bearing pattern is visually readable.

8. The print of claim 1 wherein the protective overlayer comprises inorganic particles.

9. The print of claim 8 wherein the particles comprise silica particles.

10. The print of claim 1 wherein the microspheres are selectively expanded or not depending on microsphere location.

11. The print of claim 1 wherein the microspheres are selectively expanded by various degrees of expansion and depending on location.

12. The print of claim 1 wherein the protective overlayer additionally comprises an IR absorbing dye.

13. The print of claim 1 additionally comprising a pattern where the thickness of the protective overlayer varies.

14. A process for forming an overlayer on a thermal dye transfer print comprising:

1) applying to the print a solid sheet comprising a polymeric binder containing dispersed heat expandable microspheres;

2) applying heat selectively to the surface of the overlayer sheet so that the expandable microspheres are selectively expanded in a predetermined pattern.

15. The process of claim 14 wherein the heat is applied via a thermal print head.

16. The process of claim 15 wherein the thermal print head is variable as to which pixels are energized.

17. The process of claim 15 wherein the thermal print head is variable as to the extent to which pixels are energized.

18. The process of claim 14 wherein overlayer contains an IR dye and the heat is applied via selective application of a laser beam.

19. The process of claim 15 wherein the thermal print head used to heat the protective overlayer is a separate print head from that used to transfer the imaging dye.

* * * * *